United States Patent [19]

Kamohara et al.

[11] 4,068,372

[45] Jan. 17, 1978

[54] TUBE EXPANDER

[75] Inventors: Hideaki Kamohara, Kudamatsu; Toji Nakatui, Hikari; Yuji Yoshitomi, Kudamatsu; Iwao Sasaki, Kudamatsu; Kenji Shimada, Kudamatsu, all of Japan

[73] Assignee: Hitachi, Ltd., Tokyo, Japan

[21] Appl. No.: 768,198

[22] Filed: Feb. 14, 1977

[30] Foreign Application Priority Data

Feb. 18, 1976 Japan ..... 51-15879

[51] Int. Cl.[2] ..... B23P 17/00

[52] U.S. Cl. ..... 29/727; 29/282; 29/283.5; 72/58; 72/DIG. 14

[58] Field of Search ..... 72/58, 59, 61, 62, DIG. 14; 29/421 R, 523, 727, 283.5, 282, 157.4

[56] References Cited

U.S. PATENT DOCUMENTS

| | | | |
|---|---|---|---|
| 3,152,630 | 10/1964 | Nilsson | 72/58 X |
| 3,595,047 | 7/1971 | Fenning | 72/58 |
| 3,977,068 | 8/1976 | Krips | 29/727 X |
| 4,006,619 | 2/1977 | Anderson | 72/58 X |

*Primary Examiner*—Leon Gilden

*Attorney, Agent, or Firm*—Beall & Jeffery

[57] ABSTRACT

Disclosed is a tube expander adapted for use in fixing tubes to a tube plate of a boiler or a multitubular heat exchanger. The expander incorporates an elastic expanding medium adapted to be inserted into a tube to be expanded radially against a wall of a tube-receiving bore of the tube plate. The expander further includes a pressurizing rod passing through the expanding medium, a pressurizing rod head provided at one end of the pressurizing rod, a back-up ring adapted to be supported straddling said tube receiving bore and slidably passed by the pressurizing rod, and seal rings disposed at both sides of the pressurizing rod. The seal rings are made of a hard elastic material of a hardness greater than that of the expanding medium, and each of them is provided with at its portion confronting the end of the expanding medium with a conical recess.

10 Claims, 7 Drawing Figures

TUBE EXPANDER

BACKGROUND OF THE INVENTION

The present invention relates to a tube expander for fixing tubes to a tube plate of a boiler or multitubular heat exchanger and, more particularly, to a tube expander relying upon a radial expansion of a cylindrical elastic expanding medium inserted into a tube caused by an axial compression of the medium for expanding and fixing the tube to the tube-receiving bore of the tube plate.

In manufacturing boilers and multitubular heat exchanger or the like, such a method of fixing tubes to a tube plate is getting popular as consisted in inserting a cylindrical elastic expanding medium and compressing the medium in the axial direction to cause the later to exert a radical expanding force which in turn acts on the inner peripheral wall of the tube to radially expand and tightly fix the tube to the tube plate.

Conventionally, tube expanders for carrying out the above explained method incorporates a cylindrical elastic expanding medium, a pressurizing rod passing through the medium and a back-up ring adapted to be secured straddling a tube-receiving bore of the tube plate. The pressurizing rod is connected to a piston rod in a hydraulic cylinder. In operation, the hydraulic cylinder exerts a force on a rod-head of the pressurizing rod so that the rod effects an axial compression and a consequent radial expansion of the expanding medium. The radial expansion of the medium in turn expands the tube radially and tightly fits it to the tube-receiving bore of the tube plate.

In those conventional tube expanders, as the tube is radially expanding, a gap left between the inner surface of the tube and a central boss of the back-up ring is also enlarged. Thus, part of the expanding medium inconveniently invades this enlarged gap causing a collapse or deformation of the expanding medium. This unfavorable invasion of the expanding medium takes place also at the end of the pressurizing rod opposite to the back-up ring, where a gap is formed between the rod-head of the pressurizing rod and the tube.

In order to prevent this undesirable collapse of the expanding medium, it has been proposed to put a cylindrical seal ring having parallel end surfaces between the expanding medium and the tube. This seal ring is adapted to expand radially, when compressed axially, to increase its diameter thereby to prevent the collapse of the expanding medium.

The radial deformation or displacement of the seal ring depends on the hardness of the material of the seal ring. A soft seal ring would be collapsed as it is pressed onto the back-up ring, although it may exhibit a large radial displacement to ensure a larger sealing effect. Therefore, the material of the seal ring is selected to have a larger hardness than the expanding medium.

The seal ring is, however, not effective when the expanding pressure reaches 3000 to 4000 kg/cm$^2$ as is the case where a large airtightness and a large fixing force is required between the tube and the tube plate, although it can do pretty well for thin tubes. Namely, the larger radial displacement of the seal ring for ensuring the larger sealing effect and the prevention of the collapse of the seal ring are incompatible with each other, since the collapse prevention is ensured only through an enhanced hardness which provides a poor radial displacement.

Under these circumstance, the invention is aiming at overcoming the drawbacks of the prior art by providing an improved tube expander which is free from the collapse of the expanding medium even at a large expanding pressure.

According to the invention, there is provided a tube expander comprising an elastic expanding medium adapted to be received by a tube to be expanded, a pressurizing rod passing through the expanding medium, a rod-head provided at one end of the pressurizing rod, a back-up ring slidingly passed by the pressurizing rod and seal rings made of an elastic material of a hardness greater than that of the expanding medium disposed close to both ends of the expanding medium and slidingly passed by the pressurizing rod, characterized in that a conical recess is formed in at least one seal ring at a portion thereof facing one end surface of the expanding medium.

The described and other objects, as well as the advantageous features of the invention will become clear from the following description of preferred embodiments taken in conjunction with the attached drawings in which:

DETAILED DESCRIPTION OF PREFERRED EMBODIMENTS

Figure 1:
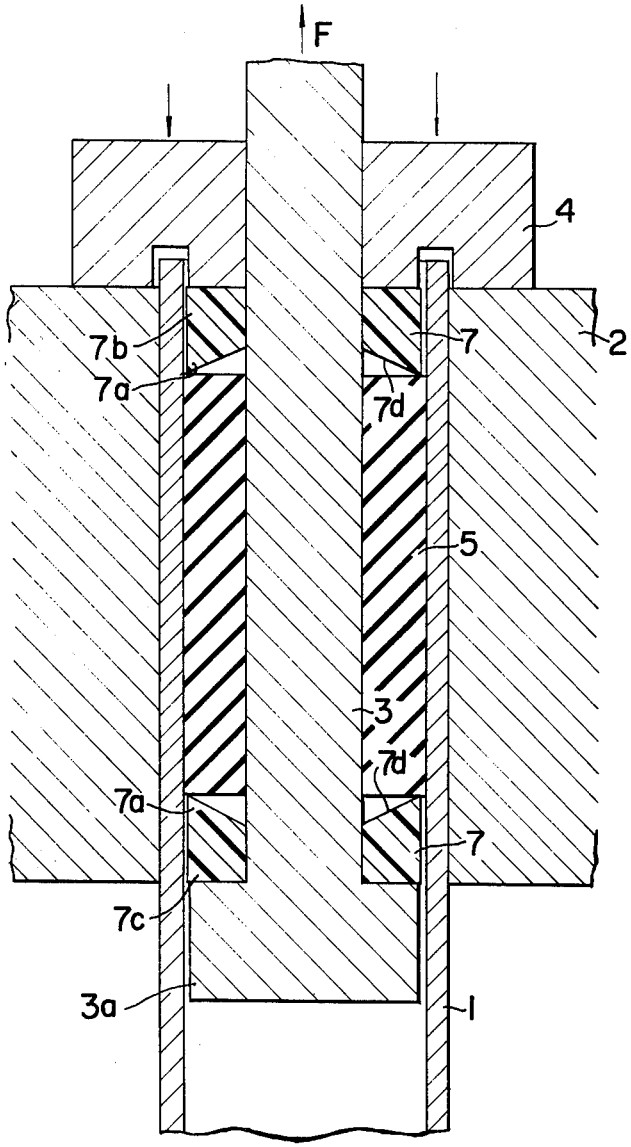
FIG. 1 shows a tube expander embodying the present invention received by a tube to be expanded, particularly a cross-section thereof before the expansion.

Referring at first to FIG. 1 which shows a cross-section of a tube expander embodying the invention received by a tube 1 to be expanded before the expansion, the tube expander includes a cylindrical expanding medium 5 made of an elastic material such as silicon rubber or natural rubber, a pressurizing rod 3 passing through the expanding medium 5, seal rings 7 disposed close to the end faces of the expanding medium and slidingly passed by the pressurizing rod 3, the seal rings 7 having conical recesses **7*d* confronting the ends of the expanding medium and being made of urethane rubber, TEFLON, epoxy or the like material, and a back-up ring 4 adapted to be secured to the end face of the tube plate 2** by straddling the tube receiving bore.

The pressurizing rod 3 is connected to a piston housed by a hydraulic cylinder which are not shown in the drawings.

The arrangement is such that an axial force F exerted by the hydraulic cylinder on a rod-head **3*a* of the pressurizing rod 3 compresses the expanding medium 5 axially, whereby a resulting radial expansion of the medium 5 expands the tube radially to tightly fit it against the tube plate 2**.

As mentioned above, the seal rings 7 incorporated in the expander of the invention are provided at their portions confronting the end surfaces of the expanding medium with conical recesses *7d*. These recesses are intended for causing a larger radial displacement of the seal rings 7 at portions *7a* thereof contacting the expanding medium than at opposite portions *7b, 7c,* when the seal rings are subjected to axial compression. The seal rings 7 are adapted to assume their original form when relieved from axial load, and are made of an elastic material for an easy insertion and withdrawal to and from the tube 1, and have a hardness larger than that of the expanding medium 5 so as not to be collapsed by the expanding pressure.

In the embodiment of FIG. 1, a seal ring having conical reces *7d* is provided at each side or end of the expanding medium 5. However, alternatively, the seal ring having conical recess may be situated at only one side of the expanding medium, preferably at the side closer to the pressurizing rod head *3a* where a comparatively greater load is imparted so as to shift axially, although it is preferable to use the conically recessed seal ring 7 at both sides of the expanding medium, in order to ensure the prevention of the collapse of the expanding medium 5.

Figure 2:
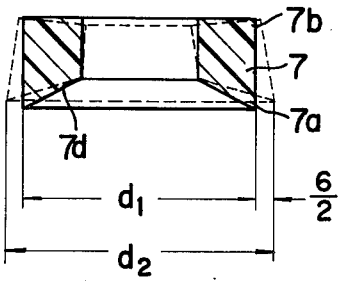
FIG. 2 is a cross-sectional illustration explaining a deflection of a seal ring incorporated in the tube expander of the invention, when the ring is axially compressed.
Figure 3:
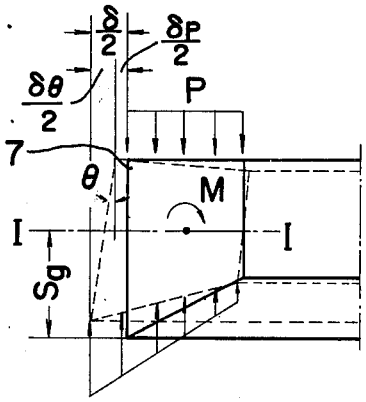
FIG. 3 is a cross-sectional illustration explaining the dynamic behavior of the seal ring when it is deflected.

Referring next to FIGS. 2 and 3 showing the manner of deflection of the seal rings, as an axial force F is applied to the pressurizing rod 3, as shown in FIG. 1, the force is transmitted through the seal ring 7 to the expanding medium 5. The axial compression exerted on the seal ring 7 appears uniformly on the surface of the seal ring 7 abutting the back-up ring 4 as substantially equally distributed surface pressure *p*, while, on the surface confronting the expanding medium 5, the pressure increases as it radiates from the center of the seal ring, due to the presence of the conical recess *7d*.

Thus, the seal ring 7 is subjected not only to the compression load but also to a bending moment M, so that the seal ring 7 is deflected to have a profile shown by a broken line.

The maximum radial displacement $\delta$ of the seal ring is the sum of a radial displacement $\delta_p$ caused by the surface pressure $p$ and that $\delta_\theta$ caused by the bending moment M, as shown in the following equation 1.

$$\delta = \delta_p + \delta_\theta \quad (1)$$

The radial displacements $\delta_p$ and $\delta_\theta$ caused by the surface pressure $p$ and the bending moment M are given by the following equations 2 and 3, respectively.

$$\delta_p = (Pd_1/E)\,\mu \quad (2)$$

$$\delta_\theta = 2Sg\cdot\theta = 2Sg\,(MR^2g/EI) \quad (3)$$

where,

P: surface pressure on the seal ring kg/cm²

Rg: centroidal radius of the cross-sectional of the seal ring mm

E: Young's modulus of the seal ring kg/mm²

Sg: distance of the seal ring from the centroid mm $\theta$: angular displacement of the seal ring M: bending moment applied to the seal ring kg-mm/mm I: moment of inertia of area around an axis I—I $d_1$: the outer diameter of the ring 7 in the relaxed condition As will be seen from the equations 2 and 3, the surface pressure $p$ and the bending moment M becomes larger as the compression load on the seal ring increases. Therefore, the radial displacement of the seal ring at the portion in contact with the expanding medium gets larger as the compression load increases, thereby to ensure a larger sealing effect and to prevent the fluidizing of the seal ring which would cause the collapse of the expanding medium.

A multitubular heat exchanger was produced employing a tube expander of the invention. No collapsing phenomena of the expanding medium (this medium was a soft rubber having a hardness of 65HsA) was observed even by a surface pressure of 3870 kg/cm², and an uniform expansion of the tube was obtained. The inner diameter of the tube was found to have been increased by about 0.5 mm, as a result of the expansion, and the gap between the outer diameter of the expanding medium and the inner diameter of the tube was 1.1 mm at the maximum.

As have been explained, thanks to the adoption of seal rings having conical recesses, a deflection of the seal ring is effected at its portion confronting the expanding medium, not only by a surface pressure but by a bending moment as well, so that a larger sealing effect is obtained promising a larger effect of preventing the collapsing phenomenas of the expanding medium.

The maximum allowable radial displacement of the seal ring can optionally determined, as far as it falls within an acceptable range for the tube-expanding, by suitably selecting the material, shape and dimension of the seal ring.

Therefore, the allowable gap between the wall of the tube-receiving bore of the tube plate and the outer surface of the tube can be made larger as compared with the tube-expansion relying upon conventional seal rings, which contributes to facilitate the insertion of the tube, resulting in a lowered cost of manufacture of the heat exchanger. In addition, the sealing mechanism for the expanding medium is considerably simplified to much facilitate maintenance and inspection of the tube expander.

Figure 4:
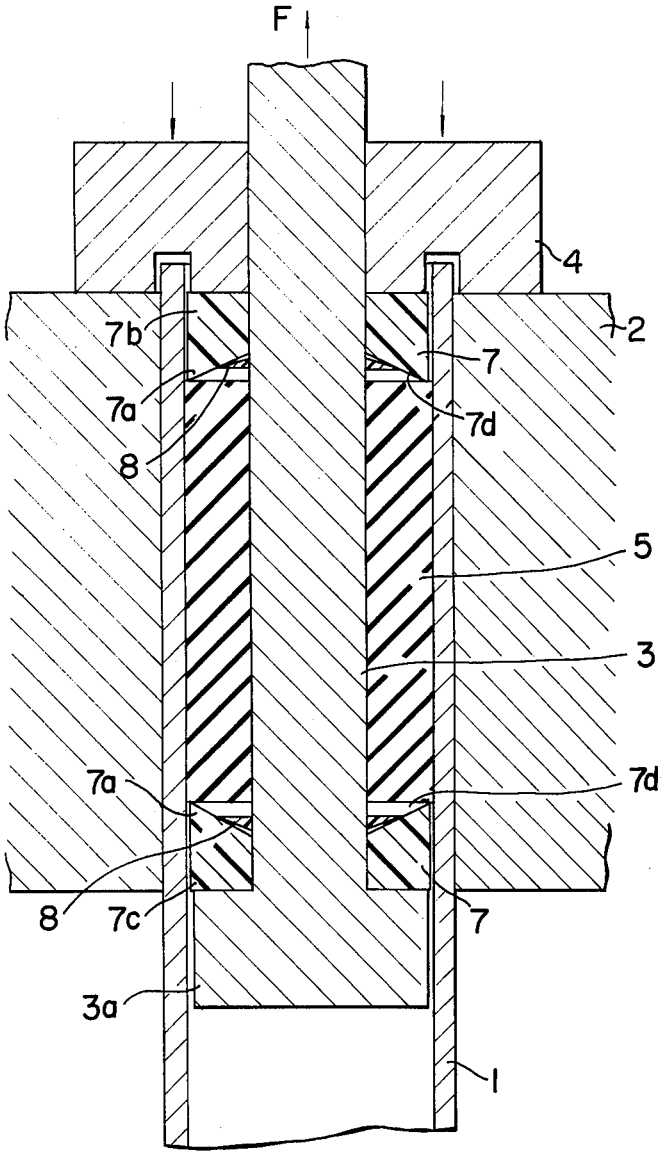
FIG. 4 is a cross-sectional view of another tube expander received by a tube to be expanded, before the expansion.

FIG. 4 shows another embodiment of the invention. A tube expander is shown in section, received by a tube 1 destined to be fitted to a tube plate 2, at a state before the expansion.

The tube expander of this embodiment comprises a pressurizing rod 3 having a head *3a*, a cylindrical expanding medium 5, a back-up ring 4 and seal rings 7 (hereinafter called conical seal rings 7) having respective conical recesses *7d*, similarly to the first mentioned embodiment.

The tube expander of this embodiment is characterized by an additional provision of an auxiliary conical seal ring 8 disposed in the conical recess of the seal ring, the auxiliary seal ring having a shape similar to that of the conical recess and being made of the same material as the seal ring.

Figure 5:
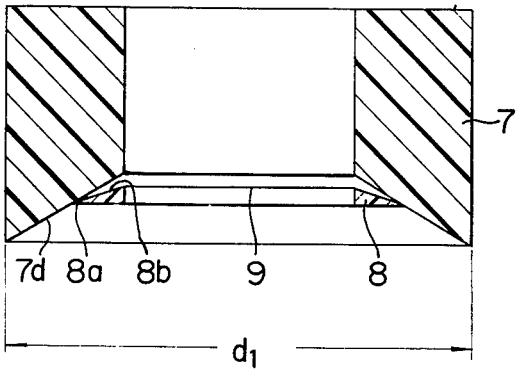
FIG. 5 is a cross-sectional view of a seal ring incorporated in the tube expander of the invention.

As will be seen from an enlarged view of FIG. 5, the auxiliary seal ring 8 has an outer peripheral edge *8a* in contact with the tapered wall of the recess *7d* . The auxiliary seal ring 8 further has a tapered surface *8b* confronting the wall of the recess *7d* of the conical seal ring 7. The tapered surface *8b* is inclined with respect to a plane normal to the axis of the ring at an angle smaller than that at which the wall of the *7d* is inclined, so that a slight gap 9 is formed between the two seal rings 7 and 8.

In use, subsequent to an insertion of the tube 1 to the tube-receiving bore of the tube plate 2, the conical seal ring 7, auxiliary seal ring 8, expanding medium 5, another auxiliary seal ring 8 and another conical seal ring 7 are fitted on the pressurizing rod 7 in the mentioned sequence.

The pressurizing rod 3 thus carrying these members is then inserted into the tube 1. A back-up ring 4 for supporting the axial compression during the expansion is then attached.

An axial force F is applied in the same manner as the first mentioned embodiment to cause the radial expansion of the expansion medium and, accordingly, of the tube.

Figure 6:
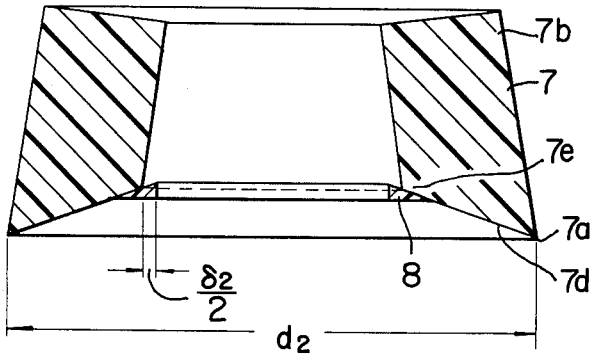
FIG. 6 is a cross-sectional view of the seal ring of FIG. 5 in a deflected state.

During this operation of expanding, the conical seal ring 7 and the auxiliary seal ring 8 play respective roles as mentioned below. The conical seal ring 7 assumes a shape as shown in FIG. 5, before the expansion, while, during the expansion the conical seal ring 7 is deformed to assume a shape as shown in FIG. 6 by the axial compression force. Thus, the peripheral edge *7a* of the conical recess *7d* exhibits a larger radial deformation than the opposite peripheral edge *7b* of the conical seal ring 7, so as to be strongly pressed against the inner surface of the tube 1, thereby to prevent the collapse of the expanding medium 5.

As a result of a repeated use of the conical seal ring 7, the inner peripheral edge *7e* of the peripheral edge of the recess *7d* is deformed radially outwardly, causing a slight gap $\delta_y$ between itself *7e* and the pressurizing rod 3. However, this gap is conveniently covered by the auxiliary seal ring 8 which has been axially moved without being deformed substantially.

In general, as the conical seal ring 7 is used for repeated continuous operations, the gap between the peripheral edge *7e* of the ring and the pressurizing rod 3 is increased considerably, so as to allow the invasion of the fluidized expanding medium. It is remarkable that this plastic flow of the expanding medium 5 is prevented by the provision of the auxiliary seal ring.

Referring to a practical example of the tube expander of the second embodiment, the expanding medium was made from a soft rubber having a hardness of 65 HsA, while the conical seal rings are formed with a hard rubber having a hardness exceeding 95 HsA. These expanding medium and the seal rings are used for expanding tubes having a diameter of 25.4 mm and a thickness of 1.7 mm. Unfavorable plastic flow of the expanding medium was not observed, and efficient and good tube-expanding was confirmed even after 1000 times of operation.

Figure 7:
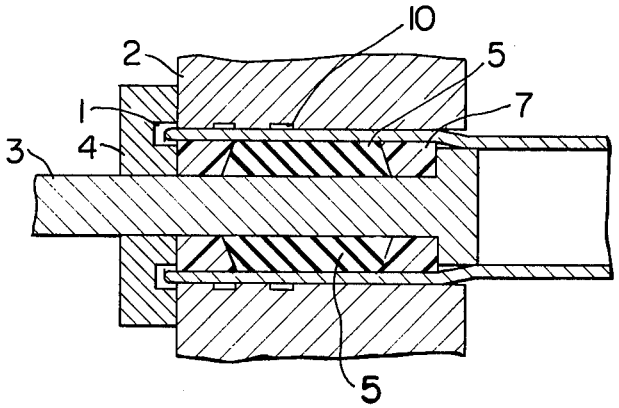
FIG. 7 is a sectional view of another example of the tube plate to which a tube is fixed by means of a tube expander of the invention, after the expansion.

In order to obtain an increased fixing force and watertightness between the tube and the tube plate, the wall of the tube-receiving bore of the tube plate can have a plurality of grooves 10, as shown in FIG. 7. The tube will then firmly gnaw into the grooves to provide an increased force of fixing and enhanced watertightness.

It will be seen from the foregoing description that the tube expander of the present invention incorporates seal rings disposed at both ends of the expanding medium, at least one of the seal rings having a conical recess at a portion thereof confronting a cylindrical recess. The conical recess causes an additional bending moment on the seal ring, when the later is compressed even by a strong expanding pressure, which in combination with the surface pressure resulted by the compression provides a larger radial deflection of the seal ring, thereby to ensure against plastic flow and a consequent collapse of the expanding medium.

What is claimed is:

1. A tube expander having a tubular, elastic expansion medium having axially opposite end surfaces and adapted to be inserted into a tube which, through a radial expansion thereof, is adapted to be fixed to a tube plate; a pressurizing rod passing through said expansion medium; a pressurizing rod head provided at one end of said pressurizing rod; a back-up ring adapted to be supported by an end of said tube plate straddling a tube-receiving bore of said tube plate, said back-up ring being telescopically received by said pressurizing rod; and seal rings each disposed to abut respective ones of said end surfaces of said expansion medium, said seal rings being of an elastic material having a hardness greater than that of said expansion medium and telescopically received by said pressurizing rod, and at least one of said seal rings having a conical recess at its portion confronting the end surface of said expansion medium.

2. A tube expander as claimed in claim 1, wherein said seal ring closest to said pressurizing rod head has said conical recess.

3. A tube expander as claimed in claim 1, wherein seal rings at both sides of said expansion medium have said conical recess.

4. A tube expander as claimed in claim 3, wherein an auxiliary seal ring is disposed in said conical recess of said seal ring.

5. A tube expander as claimed in claim 4, wherein said auxiliary seal ring has a conical shape similar to that of said conical recess of said seal ring.

6. A tube expander as claimed in claim 1, wherein said conical recess increases in axial width radially inwardly from the outermost peripheral edge of each seal ring that provides the sole engagement between the sealing rings and expansion medium prior to expansion and further provides means for exerting a bending moment on said sealing ring so as to radially expand said peripheral edge to a greater extent than the remaining portions of said sealing rings, upon expansion of said expansion ring to effectively seal the annular gap between the sealing ring and the inner diameter of the tube during expansion of the tube against axial flow of the expansion medium between the sealing rings and the tube during expansion.

7. A tube expander as claimed in claim 6, further including an auxiliary ring telescopically received on said pressurizing rod with the inner diameter of said auxiliary ring being close to the outer diameter of said pressurizing rod, said auxiliary ring having a hardness greater than that of said expansion medium, having an outer diameter substantially less than the outer diameter of each of said sealing rings, and constituting means to seal the gap between the pressurizing rod and the adjacent sealing ring as the sealing ring expands outwardly to prevent flow of the expansion medium between the pressurizing rod and the seal ring during expansion.

8. A tube expander as claimed in claim 7, wherein said auxiliary seal ring has one axial face of complimentary shape to the adjacent face of said expansion medium, and an opposite axial face that is conical at an angle with respect to a plane perpendicular to said pressurizing rod to a lesser extent than the adjacent conical face of its seal ring.

9. A tube expander as claimed in claim 1, further including an auxiliary ring telescopically received on said pressurizing rod with the inner diameter of said auxiliary ring being close to the outer diameter of said pressurizing rod, said auxiliary ring having a hardness greater than that of said expansion medium, having an outer diameter substantially less than the outer diameter of each of said sealing rings, and constituting means to seal the gap between the pressurizing rod and the adjacent sealing ring as the sealing ring expands outwardly to prevent flow of the expansion medium between the pressurizing rod and the seal ring during expansion.

10. A tube expander as claimed in claim 9, wherein said auxiliary seal ring has one axial face of complimentary shape to the adjacent face of said expansion medium, and an opposite axial face that is conical at an angle with respect to a plane perpendicular to said pressurizing rod to a lesser extent than the adjacent conical face of its seal ring.

* * * * *